US011634985B2

(12) United States Patent
Martysevich et al.

(10) Patent No.: US 11,634,985 B2
(45) Date of Patent: Apr. 25, 2023

(54) INTERPRETATION OF PUMPING PRESSURE BEHAVIOR AND DIAGNOSTIC FOR WELL PERFORATION EFFICIENCY DURING PUMPING OPERATIONS

(71) Applicant: Halliburton Energy Services, Inc., Houston, TX (US)

(72) Inventors: Vladimir Nikolayevich Martysevich, Spring, TX (US); Tirumani N. Swaminathan, Houston, TX (US); Dinesh Ananda Shetty, Sugarland, TX (US); Jianfu Ma, Pearland, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 44 days.

(21) Appl. No.: 17/267,396

(22) PCT Filed: Dec. 6, 2018

(86) PCT No.: PCT/US2018/064300

§ 371 (c)(1),
(2) Date: Feb. 9, 2021

(87) PCT Pub. No.: WO2020/117248

PCT Pub. Date: Jun. 11, 2020

(65) Prior Publication Data

US 2021/0293143 A1 Sep. 23, 2021

(51) Int. Cl.
*E21B 49/08* (2006.01)
*E21B 47/117* (2012.01)
(Continued)

(52) U.S. Cl.
CPC ..... *E21B 49/087* (2013.01); *E21B 43/26* (2013.01); *E21B 47/06* (2013.01); *E21B 47/117* (2020.05); *E21B 2200/20* (2020.05)

(58) Field of Classification Search
CPC ..... E21B 49/087; E21B 47/117; E21B 43/26; E21B 47/06; E21B 2200/20
See application file for complete search history.

(56) References Cited

U.S. PATENT DOCUMENTS 6,705,398 B2 3/2004 Weng
8,838,427 B2 9/2014 Segal et al.
(Continued)

FOREIGN PATENT DOCUMENTS

RU 2270335 2/2006
WO 2018132106 7/2018

OTHER PUBLICATIONS

Petroleum Science, Hou, et al., vol. 13, Issue 3—A new method to evaluating the injection effect of chemical flooding—2016.
(Continued)

*Primary Examiner* — Crystal J. Lee
(74) *Attorney, Agent, or Firm* — Michael Jenney; C. Tumey Law Group PLLC

(57) ABSTRACT

A method may comprise plotting treatment data to form a plot of the treatment data, fitting a function to the plot of the treatment data, determining an intercept of the function, calculating one or more coefficients, plotting the one or more coefficients on a histogram, and identifying one or more active flowpath elements on the histogram. A system may comprise a fluid handling system and an information handling system. The fluid handling system may comprise a fluid supply vessel, wherein the fluid supply vessel is disposed on a surface; pumping equipment, wherein the pumping equipment it attached to the fluid supply vessel and disposed on the surface; wellbore supply conduit, wherein the wellbore supply conduit is attached to the pumping equipment and disposed in a formation; and a plurality of
(Continued)

flowpath elements, wherein the flowpath elements fluidly couple the wellbore supply conduit to the formation.

20 Claims, 5 Drawing Sheets

(51) Int. Cl.
*E21B 43/26* (2006.01)
*E21B 47/06* (2012.01)

(56) References Cited

U.S. PATENT DOCUMENTS 9,350,627 B2 5/2016 Cremonesi et al.
9,465,123 B2 10/2016 Lin
2005/0216198 A1* 9/2005 Craig ..... E21B 49/008 702/12
2011/0120706 A1 5/2011 Craig
2014/0058686 A1 2/2014 Anderson et al.
2015/0066445 A1* 3/2015 Lin ..... G06F 30/20 703/2
2015/0204174 A1 7/2015 Kresse et al.
2016/0259088 A1 9/2016 Carvajal et al.
2018/0216442 A1 8/2018 Shetty et al.

OTHER PUBLICATIONS

SRWO International Search Report and Written Opinion for PCT/US2018/064300 dated Sep. 18, 2019.
Schlumberger, GE—Step up Test, Available at https://www.glossary.oilfield.slb.com/en/Terms/s/step_rate_test.aspx, Accessed Feb. 1, 2021.
PE—Prodigi Intelligent Fracturing Service, Datasheet, H012925, Jun. 2019.
Halliburton—AccessFrac Stimulation Service, H08720, Jun. 2013.

* cited by examiner

INTERPRETATION OF PUMPING PRESSURE BEHAVIOR AND DIAGNOSTIC FOR WELL PERFORATION EFFICIENCY DURING PUMPING OPERATIONS

BACKGROUND

Fracturing treatments are commonly used in subterranean operations, among other purposes, to stimulate the production of desired fluids (e.g., oil, gas, water, etc.) from a subterranean formation. For example, hydraulic fracturing treatments generally involve pumping a treatment fluid (e.g., a fracturing fluid) into a well bore that penetrates a subterranean formation at a sufficient hydraulic pressure to create or enhance one or more fractures in the subterranean formation. The creation and/or enhancement of these fractures may enhance the production of fluids from the subterranean formation.

Understanding stimulation fluid path in horizontal and vertical wells during hydraulic fracturing operation in unconventional reservoirs is always a challenge for the oil and gas industry. For example, during hydraulic fracturing operation an operator may have to determine perforation parameters. Parameters may include stage length, spacing between clusters, how many clusters, how many holes to shoot per cluster, etc. The ability for an operator to have insights for dynamics of flowpath discrete elements behavior during hydraulic fracturing operations as well as diagnostics pumping procedures may be beneficial.

BRIEF DESCRIPTION OF THE DRAWINGS

These drawings illustrate certain aspects of some of the present disclosure, and should not be used to limit or define the disclosure.

DETAILED DESCRIPTION

The systems, methods, and/or compositions disclosed herein may relate to subterranean operations and, in some systems and methods for determining how perforations of a wellbore may operate in an underground formation. Perforation parameters may be described as adding (opening) perforation hole/cluster and/or difference in number of holes/clusters between any of the two moments during the hydraulic fracturing treatments. These parameters may be utilized to enhance hydraulic fracturing operation.

Figure 1:
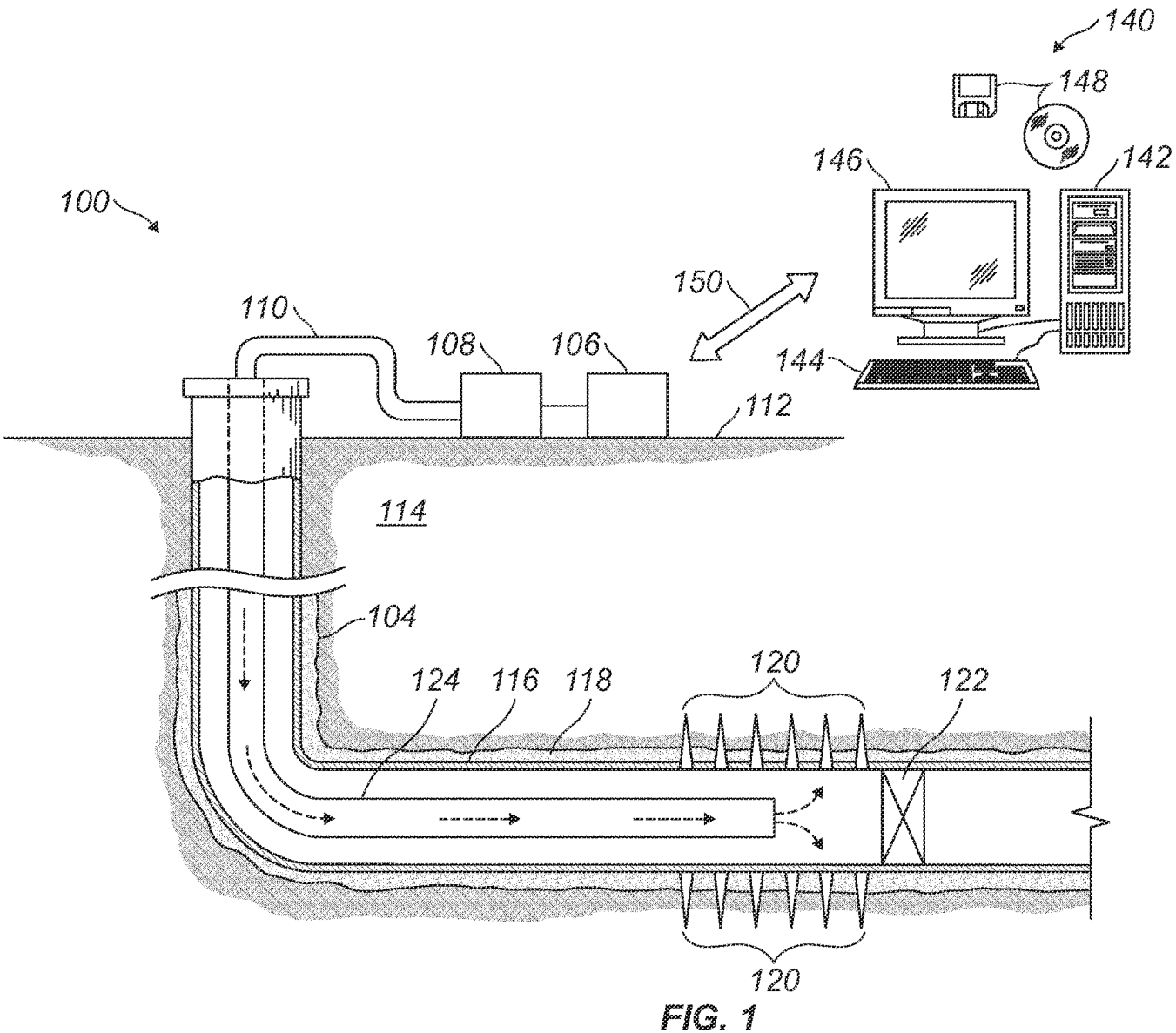
FIG. 1 is a schematic illustration of example well system showing placement of a treatment fluid into a wellbore.

FIG. 1 illustrates an example well system 100 that may be used for preparation and delivery of a treatment fluid downhole. It should be noted that while FIG. 1 generally depicts a land-based operation, those skilled in the art will readily recognize that the principles described herein are equally applicable to subsea operations that employ floating or sea-based platforms and rigs, without departing from the scope of the disclosure.

Referring now to FIG. 1, a fluid handling system 102 is illustrated. Fluid handling system 102 may be used for preparation of a treatment fluid comprising the pelletized diverting agent and for introduction of the treatment fluid into a wellbore 104. The fluid handling system 102 may include mobile vehicles, immobile installations, skids, hoses, tubes, fluid tanks or reservoirs, pumps, valves, and/or other suitable structures and equipment. As illustrated, the fluid handling system 102 may comprise a fluid supply vessel 106, pumping equipment 108, and wellbore supply conduit 110. While not illustrated, the fluid supply vessel 106 may contain one or more components of the treatment fluid (e.g., pelletized diverting agent particulates, base fluid, etc.) in separate tanks or other containers that may be mixed at any desired time. Pumping equipment 108 may be fluidically coupled with the fluid supply vessel 106 and wellbore supply conduit 110 to communicate the treatment fluid into wellbore 104. Fluid handling system 102 may also include surface and downhole sensors (not shown) to measure pressure, rate, temperature and/or other parameters of treatment. Fluid handling system 102 may also include pump controls and/or other types of controls for starting, stopping, and/or otherwise controlling pumping as well as controls for selecting and/or otherwise controlling fluids pumped during the injection treatment. An injection control system may communicate with such equipment to monitor and control the injection of the treatment fluid. As depicted in FIG. 1, the fluid supply vessel 106 and pumping equipment 108 may be above the surface 112 while the wellbore 104 is below the surface 112. As will be appreciated by those of ordinary skill in the art, well system 100 may be configured as shown in FIG. 1 or in a different manner, and may include additional or different features as appropriate. By way of example, fluid handling system 102 may be deployed via skid equipment, marine vessel, or may be comprised of sub-sea deployed equipment.

Systems and methods of the present disclosure may be implemented, at least in part, with an information handling system 140. Information handling system 140 may include any instrumentality or aggregate of instrumentalities operable to compute, estimate, classify, process, transmit, receive, retrieve, originate, switch, store, display, manifest, detect, record, reproduce, handle, or utilize any form of information, intelligence, or data for business, scientific, control, or other purposes. For example, information handling system 140 may be a personal computer 142, a network storage device, or any other suitable device and may vary in size, shape, performance, functionality, and price. Information handling system 140 may include random access memory (RAM), one or more processing resources such as a central processing unit (CPU) or hardware or software control logic, ROM, and/or other types of nonvolatile memory. Additional components of information handling system 140 may include one or more disk drives, one or more network ports for communication with external devices as well as various input and output (I/O) devices, such as a keyboard 144, a mouse, and a video display 146. Information handling system 140 may also include one or more buses operable to transmit communications between the various hardware components.

Alternatively, systems and methods of the present disclosure may be implemented, at least in part, with non-transitory computer-readable media. Non-transitory computer-readable media may include any instrumentality or aggregation of instrumentalities that may retain data and/or instructions for a period of time. Non-transitory computer-readable media may include, for example, storage media 148 such as a direct access storage device (e.g., a hard disk drive or floppy disk drive), a sequential access storage device (e.g., a tape disk drive), compact disk, CD-ROM, DVD, RAM, ROM, electrically erasable programmable read-only memory (EEPROM), and/or flash memory; as well as communications media such wires, optical fibers, microwaves, radio waves, and other electromagnetic and/or optical carriers; and/or any combination of the foregoing.

In examples, information handling system 128 may communicate with the plurality of sensors (not illustrated) through a communication line 150, which may monitor fluid handling system 102. In examples, wireless communication may be used to transmit information back and forth between information handling system 140 and the plurality of sensors. Information handling system 140 may transmit information to the plurality of sensors and may receive as well as process information recorded by the plurality of sensors. In addition, the plurality of sensors may include a downhole information handling system (not illustrated), which may also be disposed within wellbore 104. Processing may be performed at surface with information handling system 140, downhole with the downhole information handling system, or both at the surface and downhole. The downhole information handling system may include, but is not limited to, a microprocessor or other suitable circuitry, for estimating, receiving and processing signals received by the plurality of sensors. The downhole information handling system may further include additional components, such as memory, input/output devices, interfaces, and the like.

Figure 2:
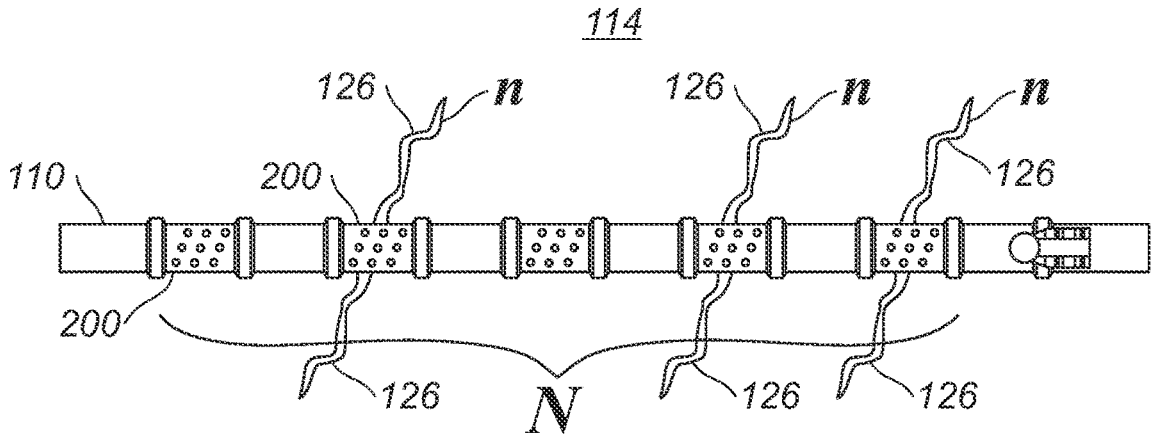
FIG. 2 is a schematic illustration of wellbore components of the flowpath from the wellbore into a formation.

FIG. 2 illustrates a wellbore 104 disposed in formation 114. Without limitation, wellbore 104 may include any number of flowpath elements 200. Flowpath elements 200 may fluidly connect wellbore 104 with formation 114, which may form fractures 126. In examples, fractures 126 may be represented in fluid handling system 102 (e.g., referring to FIG. 1) by the number of flowpath elements 200 (which may also be represented as a variable "n") which may be added or excluded from fluid handling system 102 during the pumping operations. Maximum possible number of flowpath elements 200 (which may be represented as the variable "N") may be determined by completion parameters of an identified wellbore. Examples of the discrete elements of fluid handling system 102 may include wellbore, perforation clusters or perforation holes and connected to them hydraulic fractures. During pumping operation, as the pressure in the wellbore increases, some of the hydraulic fractures may be initiated earlier than others, they may grow and connect additional perforations or clusters. While pumping fracturing fluids, proppants and other solid particulates or chemicals the discrete elements may be added (acid treatment) or excluded (screen-out, diverter plugging) from fluid handling system 102. In examples, the conditions of each flowpath element 200 may be changed dynamically (perforation erosion or near wellbore ("NWB") path change may gradually change friction coefficients). It should be noted that the NWB characteristics may determine geometry of the flowpath in volume close to the wellbore. Pressure in fluid handling system 102 may depend on friction parameters of each flowpath element 200 as well as numbers of flowpath elements 200.

Figure 3:
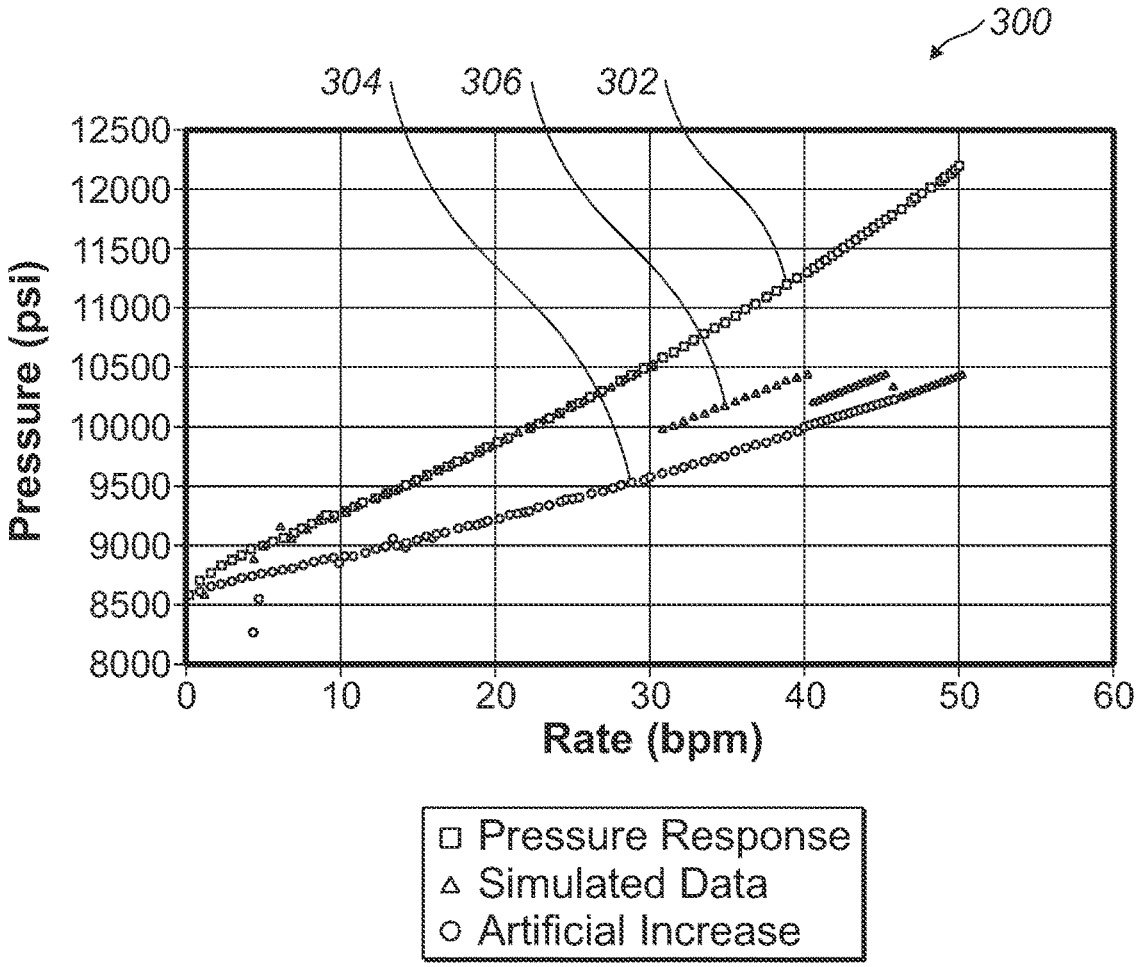
FIG. 3. is a graph of a numerical modeling results illustrating pressure response vs flowrate with different number of flowpath components available for fluid.

FIG. 3 is a graph 300 of a computer simulation of well pressure depending on flow rate with different scenarios. Pressure response 302 of the flow system with N=1, data points 304 represent simulation with N=5, data points 306 represent simulation which may artificially increase "n" in discrete manner: n=1 from O to 30 bpm, n=2 from 30 to 40 bpm, n=3 from 40 to 45 bpm, and n=5 from 45 to 50 bpm. As illustrated, pressure behavior with fixed number of elements 200 (e.g., referring to FIG. 2) may be described by a combination of square root and quadratic function, as seen below in Equation (1), thus it is driven by NWB and perforation friction.

$$P=A+C\sqrt{Q}+DQ^2 \tag{1}$$

It should be noted that P is pressure, Q is flowrate, and A, C, and D are identified coefficients determined below. During the simulation all discrete elements may be identical. The difference between pressure response 302 and data points 304 may be caused only by difference in elements (N). Also dynamic addition of the discrete elements may be observed on the plot as sudden drops (red data points).

Figure 4:
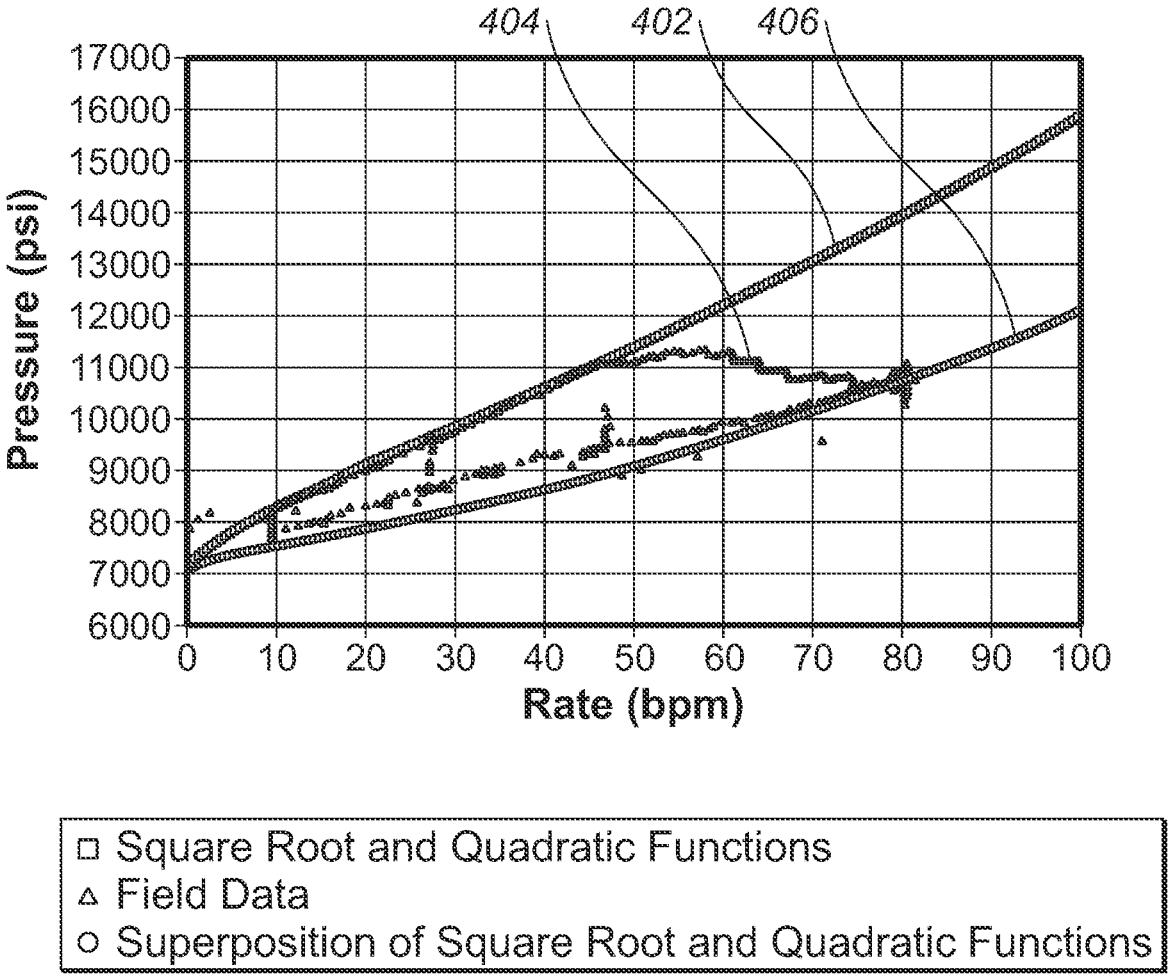
FIG. 4 is a graph at measured data with proposed model outputs plotted.

FIG. 4 is a graph 400 showing combination of superposition of square root and quadratic functions (curve 402) fitted to field data (data points 404) from the top and another superposition of square root and quadratic functions (curve 406) fitted from the bottom. Both curves have same intersection point A with pressure axis and difference between them dictated by coefficient C, at front of the square root term. Number of the pressure drop events are observed on real job plot similar to the red data points on FIG. 4. Equation (1) may be represented in a simplified form:

$$P=A+\delta Q^{\alpha} \tag{2}$$

Where δ represents the coefficient of variation. Any step change in parameter δ may be described as function of number of flow elements:

$$\Delta\delta=f(n) \tag{3}$$

During pumping operations very often it is impossible to determine current number of flowpath elements 200 (e.g., referring to FIG. 3), however maximum possible number flowpath elements 200 is known and should be related to minimum possible value of S by an operator:

$$\delta_{min}=\vartheta N \tag{4}$$

And ratio of two states of δ is equal to inverse ratio of number of elements of those states to some power m. Value of m depends on contribution of each term in Equation (3):

$$\frac{\delta_i}{\delta_j}=\left(\frac{n_j}{n_i}\right)^m \tag{5}$$

The presented method assumes α=1, and A is known and equal to local minimum in-situ stress although other choices are feasible. Knowing the ratio of elements (nj/ni) is useful for determining the effectiveness of perforation treatments like diverter drops and to decide on the future course of action to optimize this ratio.

Figure 5:
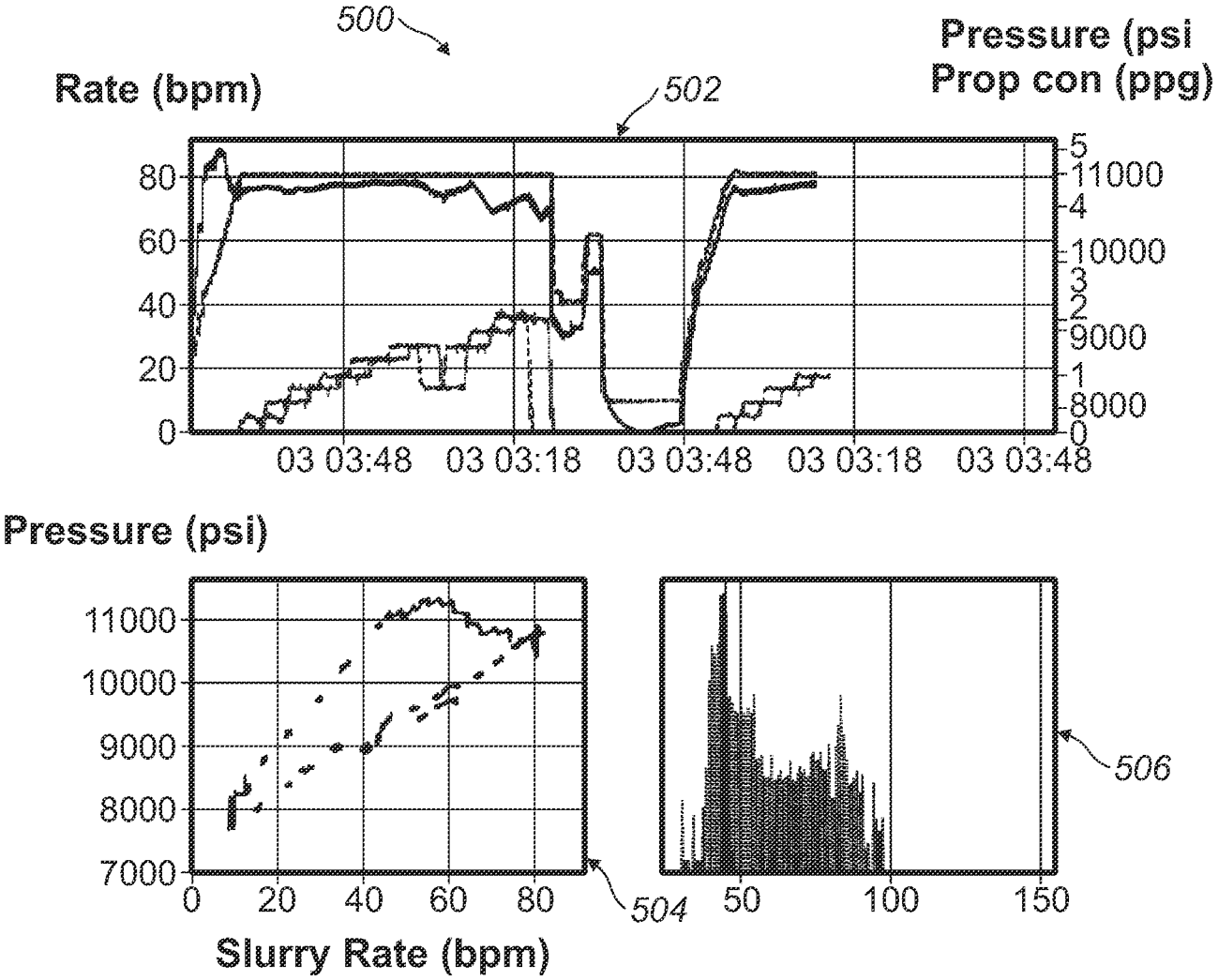
FIG. 5 is an illustration a visual display charting ongoing treatment in a wellbore.

FIG. 5 illustrates a visual display 500 which may be displayed on information handling system 140. Top chart 502 may illustrate ongoing treatment charts are going in real time. Bottom left chart 504 may illustrate treatment data in scatter plot where one axis is flow rate (Q) and second axis is pressure (P), constant A is predetermined by extrapolating pressure to rate dependency using linear or any other function and its intersection with second axis. Bottom right chart 506 may calculated slope S of the line which is connecting intersectionA and current pressure measurement is shown in the form of histogram. Local maximums of its distribution and determine their number and distance between them may be obtained from the plot. From the histogram on the bottom-right corner of FIG. 5. at least two pronounced peaks may be identified at value of $\delta_1=47$ and $\delta_2=78$. Use Equation (7) below, a ratio of two may be found:

$$\frac{\delta_i}{\delta_j} = \frac{78}{47} = 1.66 \tag{6}$$

Assuming relationship is linear or NWB friction is prevailing or perforation friction is prevailing respectively:

$$n_2=1.66n_1, n_2=3.7n_1, n_2=1.28n_1 \tag{7}$$

Figure 6:
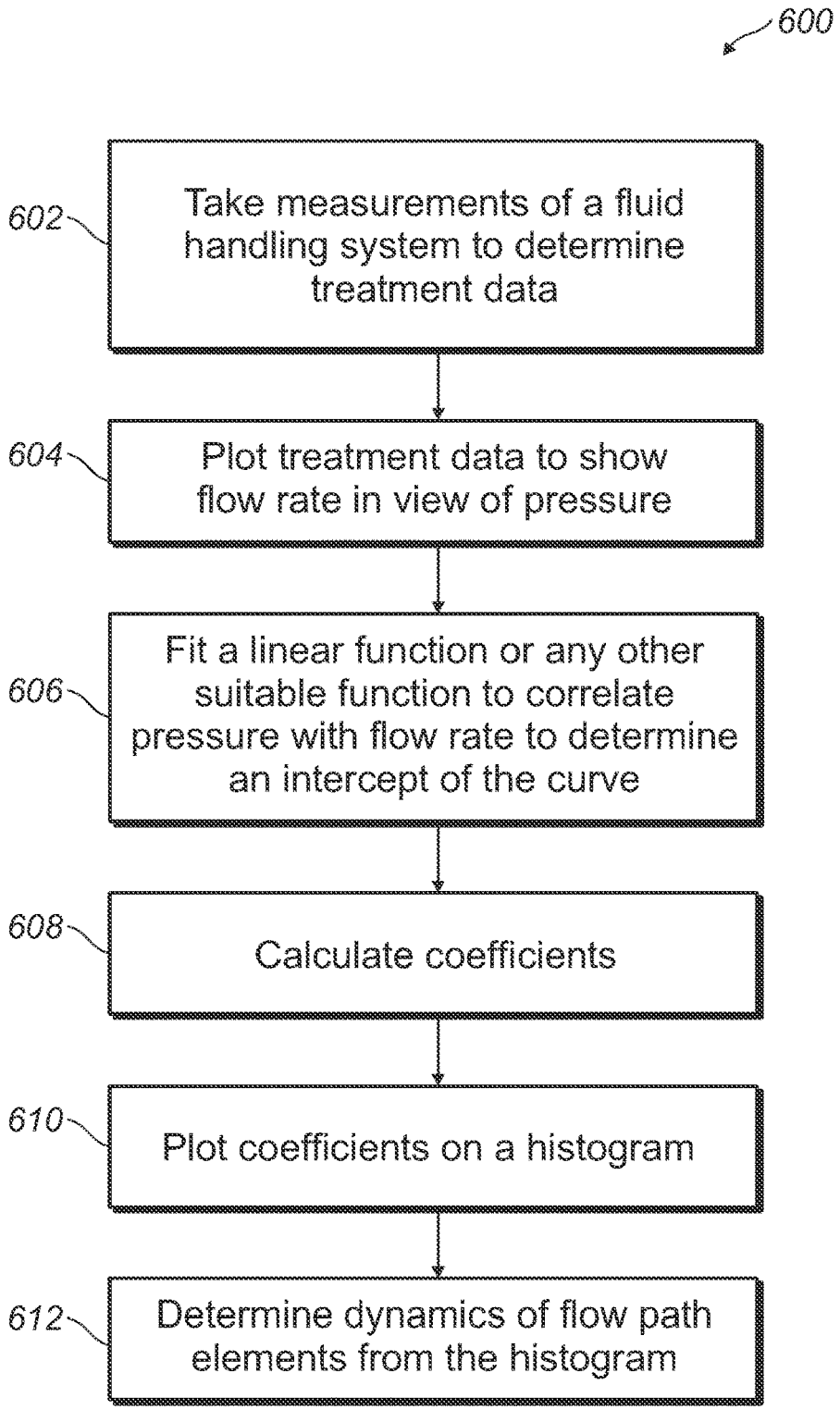
FIG. 6 is a workflow for determining downhole pumping conditions in situ.

FIG. 6 illustrates workflow 600 for determining downhole pumping conditions in situ. In step 602, an operator may take measurements of fluid handling system 102 (e.g., referring to FIG. 1) to determine treatment data. In examples, the treatment data may be information such as flow rate downhole through flowpath elements 200 (e.g., referring to FIG. 2). In step 604 an operator may use the measurements from step 602 and plot the treatment data to show flow rate in view of pressure. The resulting graph may give a picture of flow rate through flowpath elements 200 under various amounts of pressure from fluid handling system 102. In step 606, an operator, utilizing an information handling system 140 (e.g., referring to FIG. 1), may fit a linear function or any other type of function to correlate pressure with flow rate and determine an intercept of the curve. In step 608, an operator may utilize an information handling system 140 for calculate a coefficient and/or multiple coefficients of the line which is connecting an intersection and current pressure measurements. In step 610, an operator may plot coefficient and/or multiple coefficients on a graph, such as a histogram, and determining major modes and evaluating distances between each major mode. In step 612, an operator may determine dynamics of flowpath elements from the histogram in step 610. In examples, flowpath elements may be the number of holes/clusters, holes/clusters added or plugged, etc. as a ratio of these estimated coefficients.

Improvements over current technology may provide in situ pressure diagnostics, identify current perforation conditions during fracturing operations, and/or allow for an operator to make stimulation decisions during fracking operations.

This systems and methods may include any of the various features of the compositions, methods, and system disclosed herein, including one or more of the following statements.

Statement 1. A method may comprise plotting treatment data to form a plot of the treatment data; fitting a function to the plot of the treatment data; determining an intercept of the function; calculating one or more coefficients; plotting the one or more coefficients on a histogram; and identifying one or more active flowpath elements on the histogram.

Statement 2. The method of statement 1, wherein the plotting the treatment data is a pressure in view of a flow rate.

Statement 3. The method of statements 1 or 2, wherein the intercept is defined as a zero flow rate.

Statement 4. The method of statements 1-3, further comprising displaying the histogram on a video display.

Statement 5. The method of statement 4, further comprising displaying a scatter plot of the treatment data and a treatment chart in real time.

Statement 6. The method of statements 1-3, further comprising determining one or more local maximums on the histogram.

Statement 7. The method of statement 6, further comprising determining distance between one or more major modes on the histogram.

Statement 8. The method of statements 1-3 or 6, further comprising plotting a plurality of coefficients on the histogram over an identified period of time.

Statement 9. The method of statement 8, wherein the active flowpath element is a ratio of the plurality of coefficients over the identified period of time.

Statement 10. The method of statements 1-3, 6, or 8, wherein the plotting the treatment data is volumetric flow rate in view of pressure divided by density.

Statement 11. A method may comprise disposing a casing into a formation; perforating the casing with one or more elements; plotting treatment data to form a plot of the treatment data; fitting a linear function to the plot of the treatment data; determining an intercept of the function; calculating a coefficient at the intercept; plotting the coefficient on a histogram; and identifying one or more active flowpath elements from the histogram.

Statement 12. The method of statement 11, wherein the plotting the treatment data is a pressure in view of a flow rate.

Statement 13. The method of statements 11 or 12, wherein the intercept is defined as a zero flow rate.

Statement 14. The method of statements 11-13, further comprising displaying the histogram on a video display.

Statement 15. The method of statement 14, further comprising displaying a scatter plot of the treatment data and a treatment chart in real time.

Statement 16. A system may comprise a fluid handling system. The fluid handling system may comprise a fluid supply vessel, wherein the fluid supply vessel is disposed on a surface; pumping equipment, wherein the pumping equipment it attached to the fluid supply vessel and disposed on the surface; wellbore supply conduit, wherein the wellbore supply conduit is attached to the pumping equipment and disposed in a formation; and a plurality of flowpath elements, wherein the flowpath elements fluidly couple the wellbore supply conduit to the formation. The system may further comprise an information handling system configured to plot treatment data to form a plot of the treatment data; fit a function to the plot of the treatment data; determine an intercept of the function; calculate one or more coefficients; plot the one or more coefficients on a histogram; and identify one or more active flowpath elements from the histogram.

Statement 17. The system of statement 16, wherein the plotting the treatment data is a pressure in view of a flow rate.

Statement 18. The system of statements 16 or 17, wherein the intercept is defined as a zero flow rate.

Statement 19. The system of statements 16-18, further comprising displaying the histogram on a video display.

Statement 20. The system of statements 16-19, further comprising displaying a scatter plot of the treatment data and a treatment chart in real time.

The preceding description provides various examples of the systems and methods of use disclosed herein which may contain different method steps and alternative combinations of components. It should be understood that, although individual examples may be discussed herein, the present disclosure covers all combinations of the disclosed examples, including, without limitation, the different component combinations, method step combinations, and properties of the system. It should be understood that the compositions and methods are described in terms of "comprising," "containing," or "including" various components or steps, the compositions and methods can also "consist essentially of" or "consist of" the various components and steps. Moreover, the indefinite articles "a" or "an," as used in the claims, are defined herein to mean one or more than one of the element that it introduces.

For the sake of brevity, only certain ranges are explicitly disclosed herein. However, ranges from any lower limit may be combined with any upper limit to recite a range not explicitly recited, as well as, ranges from any lower limit may be combined with any other lower limit to recite a range not explicitly recited, in the same way, ranges from any upper limit may be combined with any other upper limit to recite a range not explicitly recited. Additionally, whenever a numerical range with a lower limit and an upper limit is disclosed, any number and any included range falling within the range are specifically disclosed. In particular, every range of values (of the form, "from about a to about b," or, equivalently, "from approximately a to b," or, equivalently, "from approximately a-b") disclosed herein is to be understood to set forth every number and range encompassed within the broader range of values even if not explicitly recited. Thus, every point or individual value may serve as its own lower or upper limit combined with any other point or individual value or any other lower or upper limit, to recite a range not explicitly recited.

Therefore, the present examples are well adapted to attain the ends and advantages mentioned as well as those that are inherent therein. The particular examples disclosed above are illustrative only, and may be modified and practiced in different but equivalent manners apparent to those skilled in the art having the benefit of the teachings herein. Although individual examples are discussed, the disclosure covers all combinations of all of the examples. Furthermore, no limitations are intended to the details of construction or design herein shown, other than as described in the claims below. Also, the terms in the claims have their plain, ordinary meaning unless otherwise explicitly and clearly defined by the patentee. It is therefore evident that the particular illustrative examples disclosed above may be altered or modified and all such variations are considered within the scope and spirit of those examples. If there is any conflict in the usages of a word or term in this specification and one or more patent(s) or other documents that may be incorporated herein by reference, the definitions that are consistent with this specification should be adopted.

What is claimed is:

1. A method, comprising:

measuring hydraulic fracture treatment data from at least a pressure sensor and a flow rate sensor during a hydraulic fracturing operation;

plotting the hydraulic fracture treatment data to form a plot of the hydraulic fracture treatment data;

fitting a function to the plot of the hydraulic fracture treatment data;

determining an intercept of the function;

calculating one or more coefficients;

plotting the one or more coefficients on a histogram; and identifying one or more active flowpath elements on the histogram, wherein the one or more active flowpath elements are one or more perforation holes or perforation clusters.

2. The method of claim 1, wherein the plotting the hydraulic fracture treatment data is a pressure in view of a flow rate.

3. The method of claim 1, wherein the intercept is defined as a zero flow rate.

4. The method of claim 1, further comprising displaying the histogram on a video display.

5. The method of claim 4, further comprising displaying a scatter plot of the hydraulic fracture treatment data and a hydraulic fracture treatment chart in real time.

6. The method of claim 1, further comprising determining one or more local maximums on the histogram.

7. The method of claim 6, further comprising determining distance between one or more major modes on the histogram.

8. The method of claim 1, further comprising plotting a plurality of coefficients on the histogram over an identified period of time.

9. The method of claim 8, wherein the active flowpath element is a ratio of the plurality of coefficients over the identified period of time.

10. The method of claim 1, wherein the plotting the hydraulic fracture treatment data is volumetric flow rate in view of pressure divided by density.

11. A method, comprising:

disposing a casing into a formation;

perforating the casing with one or more elements;

measuring hydraulic fracture treatment data from at least a pressure sensor and a flow rate sensor during a hydraulic fracturing operation;

plotting the hydraulic fracture treatment data to form a plot of the hydraulic fracture treatment data;

fitting a linear function to the plot of the hydraulic fracturing treatment data;

determining an intercept of the function;

calculating a coefficient at the intercept;

plotting the coefficient on a histogram; and identifying one or more active flowpath elements from the histogram, wherein the one or more active flowpath elements are one or more perforation holes or perforation clusters.

12. The method of claim 11, wherein the plotting the hydraulic fracturing treatment data is a pressure in view of a flow rate.

13. The method of claim 11, wherein the intercept is defined as a zero flow rate.

14. The method of claim 11, further comprising displaying the histogram on a video display.

15. The method of claim 14, further comprising displaying a scatter plot of the hydraulic fracturing treatment data and a hydraulic fracturing treatment chart in real time.

16. A system comprising:

a fluid handling system comprising:

a fluid supply vessel, wherein the fluid supply vessel is disposed on a surface;

pumping equipment, wherein the pumping equipment is fluidically connected to the fluid supply vessel and disposed on the surface;

a wellbore supply conduit, wherein the wellbore supply conduit is attached to the pumping equipment and disposed in a formation; and a plurality of flowpath elements, wherein the flowpath elements fluidically couple the wellbore supply conduit to the formation; and an information handling system configured to:

communicate with at least a pressure sensor and a flow rate sensor during a hydraulic fracturing operation;

plot hydraulic fracturing treatment data to form a plot of the hydraulic fracturing treatment data;

fit a function to the plot of the hydraulic fracturing treatment data;

determine an intercept of the function;

calculate one or more coefficients;

plot the one or more coefficients on a histogram; and identify one or more active flowpath elements from the histogram, wherein the one or more active flowpath elements are one or more perforation holes or perforation clusters.

17. The system of claim 16, wherein the plotting the hydraulic fracturing treatment data is a pressure in view of a flow rate.

18. The system of claim 16, wherein the intercept is defined as a zero flow rate.

19. The system of claim 16, further comprising displaying the histogram on a video display.

20. The system of claim 19, further comprising displaying a scatter plot of the hydraulic fracturing treatment data and a hydraulic fracturing treatment chart in real time.

* * * * *